US008869377B2

(12) United States Patent
Mehta

(10) Patent No.: US 8,869,377 B2
(45) Date of Patent: Oct. 28, 2014

(54) INTEGRATED VALVE SLEEVE

(76) Inventor: Shreyas R. Mehta, Scarsdale, NY (US)

( * ) Notice: Subject to any disclaimer, the term of this patent is extended or adjusted under 35 U.S.C. 154(b) by 653 days.

(21) Appl. No.: 13/085,865

(22) Filed: Apr. 13, 2011

(65) Prior Publication Data

US 2012/0137520 A1 Jun. 7, 2012

Related U.S. Application Data

(60) Provisional application No. 61/420,472, filed on Dec. 7, 2010.

(51) Int. Cl.

| | |
|---|---|
| ***B23P 25/00*** | (2006.01) |
| ***B21J 5/12*** | (2006.01) |
| ***B21J 5/02*** | (2006.01) |
| ***B21K 1/20*** | (2006.01) |
| ***B21K 3/00*** | (2006.01) |

(52) U.S. Cl.

CPC .. *B21J 5/025* (2013.01); *B21J 5/12* (2013.01); *B21K 1/20* (2013.01); *B21K 3/00* (2013.01); *B21J 5/02* (2013.01)

USPC ..... 29/527.5; 29/522.1; 29/527.1; 72/354.8; 72/356; 72/353.2; 72/377

(58) Field of Classification Search

CPC ..... B22D 19/00; B23P 15/001

USPC ..... 29/522.1, 527.1, 527.5, 557, 558; 72/354.8, 356, 353.2, 377

See application file for complete search history.

(56) References Cited

U.S. PATENT DOCUMENTS 5,373,720 A * 12/1994 Ratte et al. ..... 72/354.8

* cited by examiner

*Primary Examiner* — Richard Chang
(74) *Attorney, Agent, or Firm* — IP Attorneys Group

(57) ABSTRACT

The invention relates to an Integrated Valve Sleeve for a spool and sleeve valve and solenoid housing for accepting a solenoid assembly. The apparatus is integrated insofar as it is fashioned from one piece of malleable material through a cold-forging process, thus avoiding the structural weakness endowed in similar assemblies formed through welding processes and the like.

19 Claims, 16 Drawing Sheets

INTEGRATED VALVE SLEEVE

CROSS REFERENCE TO COPENDING APPLICATIONS

This application claims priority to U.S. Provisional Patent Application No. 61/420,472 filed on Dec. 7, 2010, titled "Integrated Valve Sleeve." The contents of the above-identified application are relied upon and incorporated herein by reference in its entirety.

FIELD OF INVENTION

The invention relates to a method of providing an Integrated Valve Sleeve and solenoid housing.

BACKGROUND OF INVENTION

Solenoid assemblies are typically found in a myriad of modern products, from the control of anti-lock braking systems and dual-clutch transmissions in automobiles, to pressurized water control in irrigation systems, to more general uses such as in doors, windows, many hydraulic controls, and the like.

Solenoid assemblies are often provided with an outer casing used to hold and protect the inner components. This outer case, or housing, normally provides protection along the length of the assembly and may be augmented with the use of an end cap to protect the base of the assembly as well. The inner components can include features such as a solenoid coil, leads, and all valve components among other components deemed necessary by the specific process the assembly is involved in. In the instance of a spool and sleeve valve, an inner valve sleeve may be incorporated to allow for proper alignment of the spool and various other valve components, as well as for providing the necessary flow channels for the solenoid and spool to selectively control. The solenoid housing, along with this inner valve sleeve and other components, make up the structural backbone of the solenoid assembly. These structural components of the assembly are usually welded together to form a single structure or may be simply nested or stacked one inside of another to keep the interior components stable and to achieve more reliably repeatable function from the solenoid assembly.

The traditional methods of assembly, however, present several disadvantages. Welding the aforementioned protective and structural components of the solenoid assembly together can produce structural weaknesses at the welding junctions, leading to potentially vastly shortened operational lifespans. Further, with components often being of a relatively small size, the welding itself may require a significant amount of skill and time to produce a quality finished product. Simple nesting of these components may be advantageous compared to welding due to the increased ease of assembly, but that advantage could be mitigated by a loss of long-term durability.

Further, whether the method of assembly is from welding or nesting, components are still likely to be machined and assembled individually. Such practice can be highly labor intensive and time consuming and the machines required to produce these components are often expensive, large, and require a great deal of skill to operate properly.

U.S. Patent Application No. 2002/0047304 A1 teaches a valve sleeve which can be formed as a one piece closed end tube [0013]. More specifically, '304 teaches a FIG. 1, relating to an assembly providing a valve sleeve 16, flux return casing 21and valve casing 11. While valve 16 and flux return casing 21 appear to be integrally connected, assembly of these part is still required, such as by welding or stacking, and are therefore subject to all the above mentioned disadvantages of both. Further, valve casing 11 is separated from both the valve sleeve 16 and flux return 21, creating a disadvantageous weak point at the base of the valve sleeve 16. Finally, valve sleeve 16 is provided with a cap 40, as demonstrated in FIG. 3. The two components are assembled through a traditional welding process, once again making the solenoid assembly subject to all the disadvantages associated with such assembly processes. "In the preferred embodiment, the cap 40 is secured to the sleeve 16 by a conventional welding process, such as, for example laser or friction welding." [0029]

U.S. Pat. No. 7,665,713 B1 appears to show an integrated solenoid assembly in FIG. 7, which portrays features of a solenoid 20B comprising a main outer cylindrical shell or housing 46, central spool 48, and a pair of yokes 50 among other features. As is evident from FIG. 7, the structural components of solenoid 20B must be assembled, creating inherent weak points in the construction.

U.S. Pat. No. 5,301,920 discloses a FIG. 3, which shows a body 30 of a solenoid valve, further comprising a valve sleeve 31. However, the assembly of the apparatus is accomplished simply by stacking the individual components in the body 30, and is then held in claims through the use of guide portions in the body 30. "In this embodiment . . . sleeve 31 . . . (is) guided by the respective guide portions formed on the inner wall of the body 30 . . . Also, since . . . sleeve 31 (is) installed simply by stacking them in the body in this order, the construction is simplified and the assembling work is facilitated" (col. 6, lines 52-63). The prior invention, therefore, appears to actually teach away from an integrated sleeve and housing design in the interest of ease of assembly.

U.S. Pat. No. 5,603,483 discloses a valve sleeve as shown in FIG. 5 and a solenoid assembly embodiment in FIG. 4 featuring said valve sleeve. However, the various components of the housing and internal sleeve components are obviously assembled from individually machined pieces and therefore are subject to the inherent disadvantages mentioned above.

What is desired, therefore, is a method of making a solenoid housing and a valve sleeve that reduces the structural and fabrication complexity in the above prior art. Also desirable is to have a solenoid housing and valve sleeve that do not require the individual machining of components and the potentially complex assembly of those components. It is further desired to have a method that not only reduces the mechanical complexity, but produces a product with an improved lifespan and durability from the elimination of unnecessary weak points introduced through assembly processes such as welding, stacking, and the like. In addition, it is desired that while eliminating all the aforementioned disadvantages, there should be no sacrifice of manufacturing efficiency, no significant increase of cost, and no decrease in performance.

SUMMARY OF INVENTION

It is therefore an object of the invention to provide a method of making an integrated valve sleeve which eliminates weakness in construction potentially introduced through traditional assembly processes. It is also an object of the invention to provide a method of making an integrated valve sleeve that eliminates the needlessly complex machining and assembling processes of the prior art. It is additionally an object of this invention to provide a method of making an integrated valve sleeve which allows for efficient manufacturing without significant increases in cost or decreases in the performance of the finished product. In one embodiment, this is done through a method of providing an integrated valve sleeve which comprises the steps of providing a cylinder of malleable material having a first part, a second part, and a third part, wherein both the first part and the second part have a diameter, reducing the diameter of the first part of the cylinder to be less than the diameter of the second part of the cylinder, raising the second part of the cylinder in a first location in a direction away from the first part of the cylinder, wherein the first location of the second part of the cylinder defines a first raised wall, expanding the third part of the cylinder in a first portion of the cylinder in a direction substantially perpendicular to both the first part and the second part, raising the second part of the cylinder in a second location in a direction away from the first part of the cylinder, wherein the second location of the second part of the cylinder defines a second raised wall, wherein all of the first part, second part, third part, first raised wall, and second raised wall are formed from the cylinder material. In another embodiment, there may additionally be a step for creating at least one groove and at least one hole on a surface of the cylinder. In yet another embodiment, the method may provide a step for maintaining the mass of the cylinder at a substantially constant value throughout a reduction of the diameter of the first part and creation of the first raised wall, second raised wall, and expansion of the third part.

Other embodiments may further comprise the step of shaping at least a portion of one feature selected from a group consisting of: the first part of the cylinder, an area defined by a tapered surface between the first part of the cylinder and the second part of the cylinder, and any combination thereof. In additional embodiments, the step of raising the second part of the cylinder in a first location comprises an additional step of compressing at least a second portion of the second part of the cylinder in an axial direction toward the first part of the cylinder. In still further embodiments, the step of expanding the third part comprises the additional step of expanding the third part in a first portion of the cylinder between the first part of the cylinder and the second part of the cylinder by compressing the first part of the cylinder in an axial direction toward the second part of the cylinder.

In another embodiment the step of raising the second part of the cylinder in a second location comprises the step of further compressing at least a third portion of the second part of the cylinder in an axial direction toward the first part of the cylinder, wherein the step of further compressing at least the second portion of the cylinder in an axial direction toward the first part of the cylinder allows the circumference of the first raised wall to remain substantially unaltered.

Further embodiments require the step of magnetically annealing the integrated valve sleeve. This magnetic annealing step can occur after at least one of the steps of providing a cylinder of malleable material having a first part and a second part, wherein both the first part and the second part have a diameter, reducing the diameter of the first part of the cylinder to be less than the diameter of the second part of the cylinder, raising the second part of the cylinder in a first location in a direction away from the first part of the cylinder, wherein the raised first location of the second part of the cylinder defines a first raised wall, expanding a third part of the in a direction substantially perpendicular to both the first part and the second part, or raising the second part of the cylinder in a second location in a direction away from the first part of the cylinder, wherein the raised second location of the second part of the cylinder defines a second raised wall. Yet other embodiments contemplate an additional step of controlling a relative length, width, thickness, and diameter of at least one of the following features: the first part of the cylinder, the second part of the cylinder, the third part of the cylinder, the first raised wall, and the second raised wall.

In some embodiments, the step of creating at least one groove and at least one hole on a surface of the integrated valve sleeve is accomplished using a method selected from a group consisting of: cold-forging, machining, and combinations thereof. Additional embodiments can further comprise steps of machining or cold-forging at least one groove, wherein the groove has a depth and a width, machining or cold-forging at least one hole through substantially an entire diameter of the integrated valve sleeve, wherein the hole has a depth and a diameter, machining or cold-forging the hole adjacent to the at least one groove, controlling the depth and width of the groove, and controlling the depth and diameter of the hole. Other embodiments contemplate that the step of creating the at least one groove on a surface of the integrated valve sleeve is performed by a machining process selected from a group consisting of: spin forming, shear forming, ultrasonic forming, chemical forming, or combinations thereof.

In another embodiment, the step of compressing at least a second portion of the second part of the cylinder in an axial direction toward the first part of the cylinder includes reverse extruding the at least the first location of the second part of the cylinder through a die. Or in yet another embodiment, the step of further compressing at least a third portion of the second part of the cylinder in an axial direction toward the first part of the cylinder includes reverse extruding the at least the second location of the second part through a die. In further embodiments, there may be the step of orientating a plurality grain lines.

In additional embodiments, a method of providing an integrated valve sleeve is envisioned which includes the steps of providing a cylinder of malleable material having a first part, a second part, and a third part, wherein both the first part and the second part have a diameter, reducing the diameter of the first part of the cylinder to be less than the diameter of the second part of the cylinder, raising the second part of the cylinder in a first location in a direction away from the first part of the cylinder, wherein the first location of the second part of the cylinder defines a first raised wall, expanding a third part of the cylinder in a first portion of the cylinder in a direction substantially perpendicular to both the first part and the second part, raising the second part of the cylinder in a second location in a direction away from the first part of the cylinder, wherein the second location of the second part of the cylinder defines a second raised wall, creating at least one groove and at least one hole on a surface of the integrated valve sleeve, and orientating a plurality of grain lines, wherein all of the first part, second part, third part, first raised wall, and second raised wall are formed from the cylinder material. In a further embodiment, those steps include the step of creating at least one groove and at least one hole on a surface of the integrated valve sleeve is accomplished by a method selected from a group consisting of: cold-forging, machining, or combinations thereof.

Yet a further embodiment can comprise the steps of providing a cylinder of malleable material having a first part, a second part, and a third part, wherein both the first part and the second part have a diameter, reducing the diameter of the first part of the cylinder to be less than the diameter of the second part of the cylinder, raising the second part of the cylinder in a first location in a direction away from the first part of the cylinder by compressing at least a first portion of the second part of the cylinder in an axial direction toward the first part of the cylinder, wherein the first location of the second part of the cylinder defines a first raised wall, expanding a third part between and substantially perpendicular to the first part of the cylinder and the second part of the cylinder by compressing the first part of the cylinder in an axial direction toward the second part of the cylinder, and raising the second part of the cylinder in a second location in a direction away from the first part of the cylinder by further compressing at least a second portion of the second part of the cylinder in an axial direction toward the first part of the cylinder, wherein the second location of the second part of the cylinder defines a second raised wall, wherein all of the first part, second part, third part, first raised wall, and second raised wall are formed from the cylinder material. Additionally, a further embodiment contemplates creating at least one groove and at least one hole on a surface of the integrated valve sleeve, while yet further embodiments comprise the step of at least one groove and at least one hole on a surface of the integrated valve sleeve is accomplished by a method selected from a group consisting of: cold-forging, machining, and combinations thereof.

BRIEF DESCRIPTION OF FIGURES

The features of the invention believed to be novel and the elements characteristic of the invention are set forth with particularity in the appended claims. The figures are for illustration purposes only and are not drawn to scale. The invention itself, however, both as to organization and method of operation, may be understood by reference to the detailed description which follows taken in conjunction with the accompanying drawings in which:

DETAILED DESCRIPTION OF DRAWINGS

In describing the following embodiments of the present invention, reference will be made herein to FIGS. 1-21 of the drawings in which like numbers refer to like features of the invention.

Figure 1:
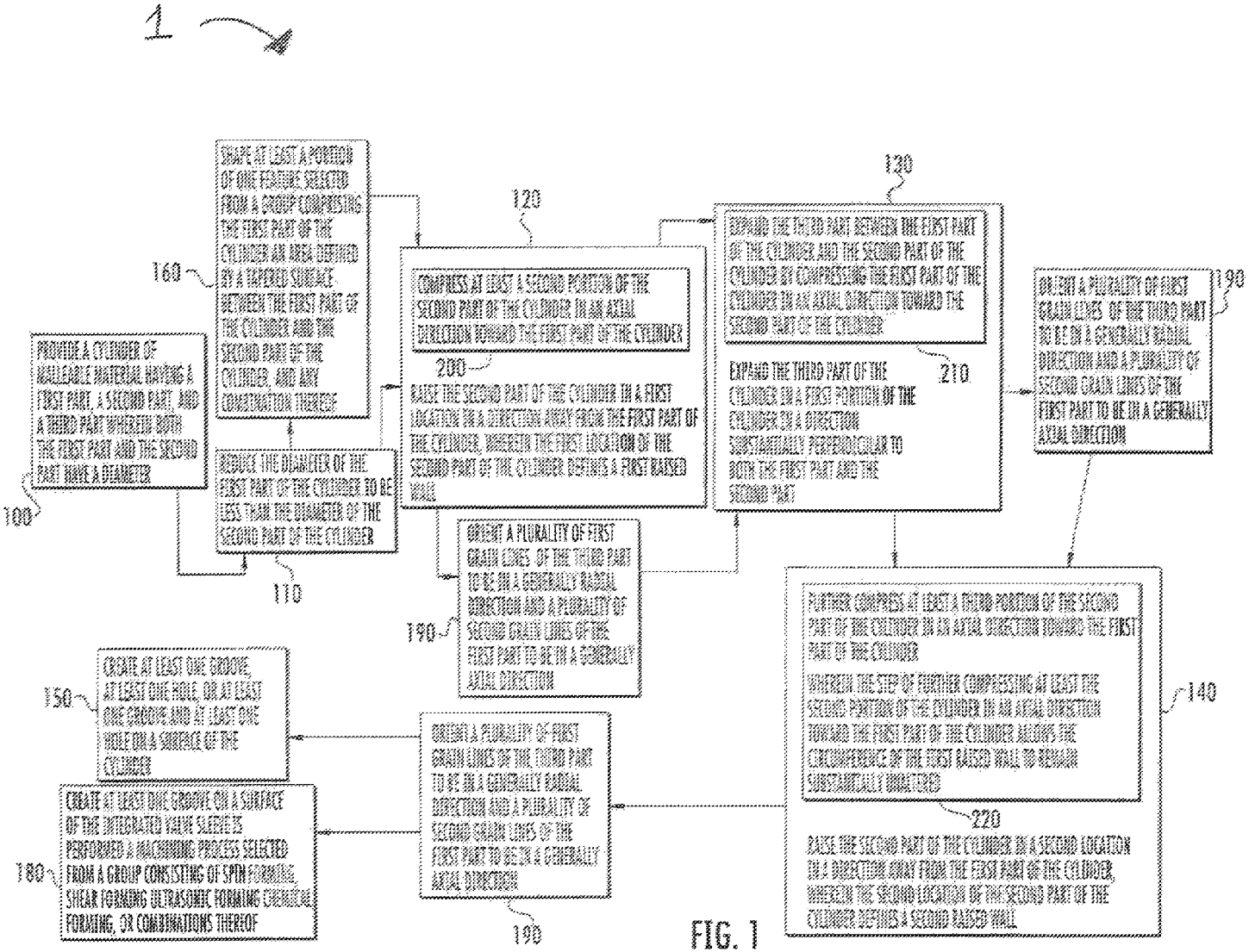
FIG. 1 depicts a flowchart for an embodiment of a method of providing an Integrated Valve Sleeve.

FIG. 1 depicts a method 1 for providing an integrated valve sleeve in accordance with the invention, where the integrated valve sleeve is produced from a single cylinder of malleable material. One of the advantages of this method is the integration of all structural components through a cold-forging method, thus eliminating potential structural weaknesses at joints caused by traditional and complex valve sleeve/solenoid housing fabrication methods such as welding. The instant invention's method 1 provides for a seamless construct through cold-forging of the initial single cylinder of malleable material. Though this application will make constant reference to the method being performed by cold-forging for the sake of clarity, one embodiment is also envisioned where the forming steps of the invention may also be performed by cold-extrusion.

As shown in FIG. 1, the method 1 comprises steps of providing 100 a cylinder of malleable material having a first part, a second part, and a third part, reducing 110 the diameter of the first part of the cylinder to be less than the diameter of the second part of the cylinder, raising 120 the second part of the cylinder in a first location in a direction away from the first part of the cylinder, such that the first location of the second part of the cylinder defines a first raised wall, expanding 130 the third part in a first portion of the cylinder in a direction substantially perpendicular to both the first part and the second part of the cylinder, raising 140 the second part of the cylinder in a second location in a direction away from the first part of the cylinder, such that the second location of the second part of the cylinder defines a second raised wall, and creating 150 a least one hole, at least one groove, or at least one hole and at least one groove on the surface of the cylinder of malleable material. These steps need not be performed in the order as they are listed above. In one embodiment, the expanding step 130 may be performed after raising step 140, for example. Additionally, it is contemplated that the second raised wall may be either hollow (such as in a cup conformation) or solid (such as in a pole conformation), depending on the desires of the user and intended use of the finished product.

Figure 2:
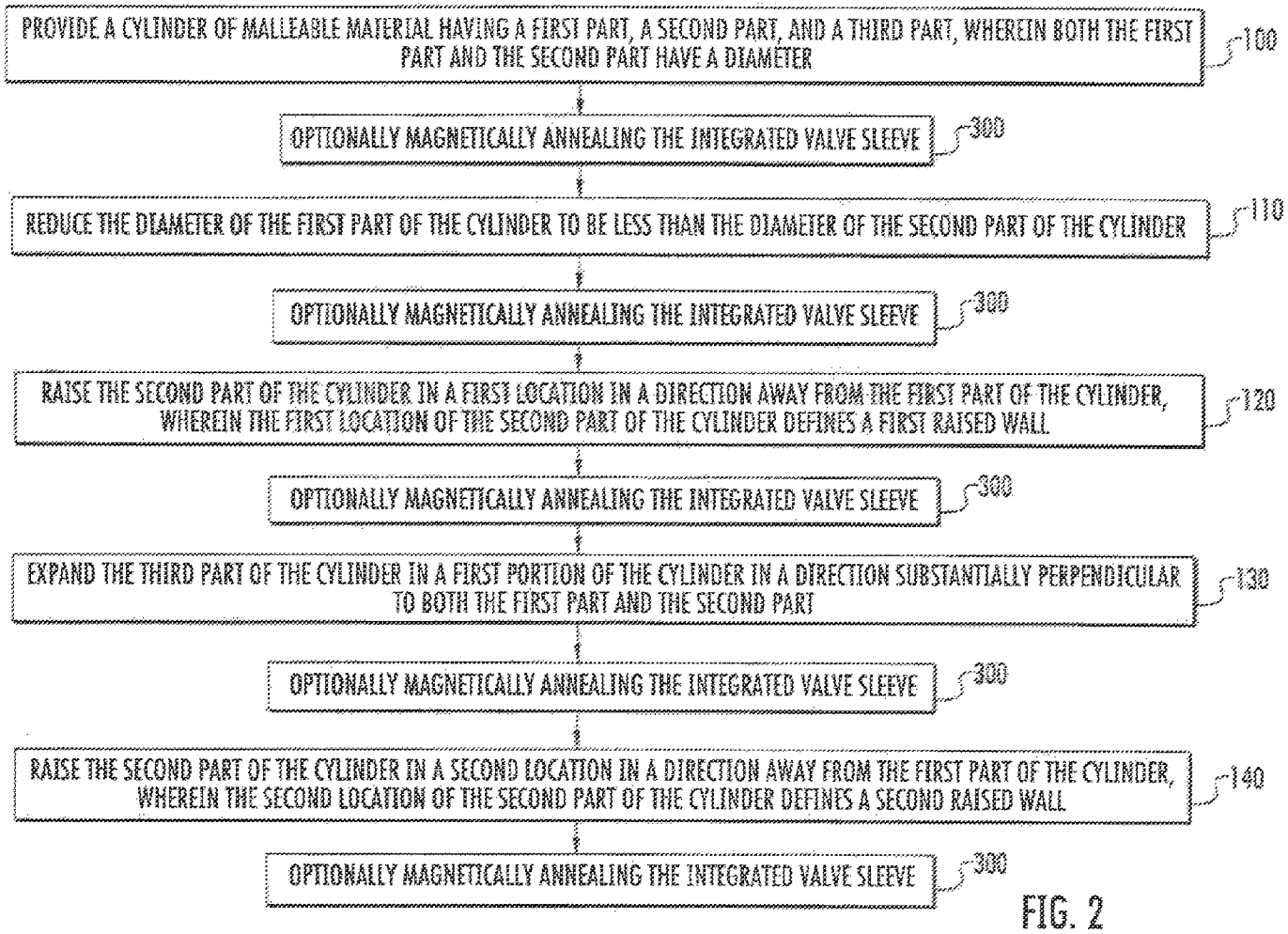
FIG. 2 depicts an embodiment of the method of providing an Integrated Valve Sleeve shown in FIG. 1.

FIG. 2 depicts an embodiment where the cylinder of malleable material is magnetically annealed 300 between any of the steps seen in FIG. 1. Magnetically annealing the cylinder softens the material being shaped before a forming step, such as those depicted in FIG. 1. The advantage of these annealing steps is a decreased stress on the dies, pressing apparatus, and the cylinder of malleable material itself. Repeated cold-forging without annealing will lead to shorter operational lifetimes of the manufacturing components. Further, repeated cold-forging of the cylinder of malleable material without annealing can cause the material to become progressively more brittle after each instance, increasing the likelihood of defects and failures of the valve sleeve.

Figure 3:
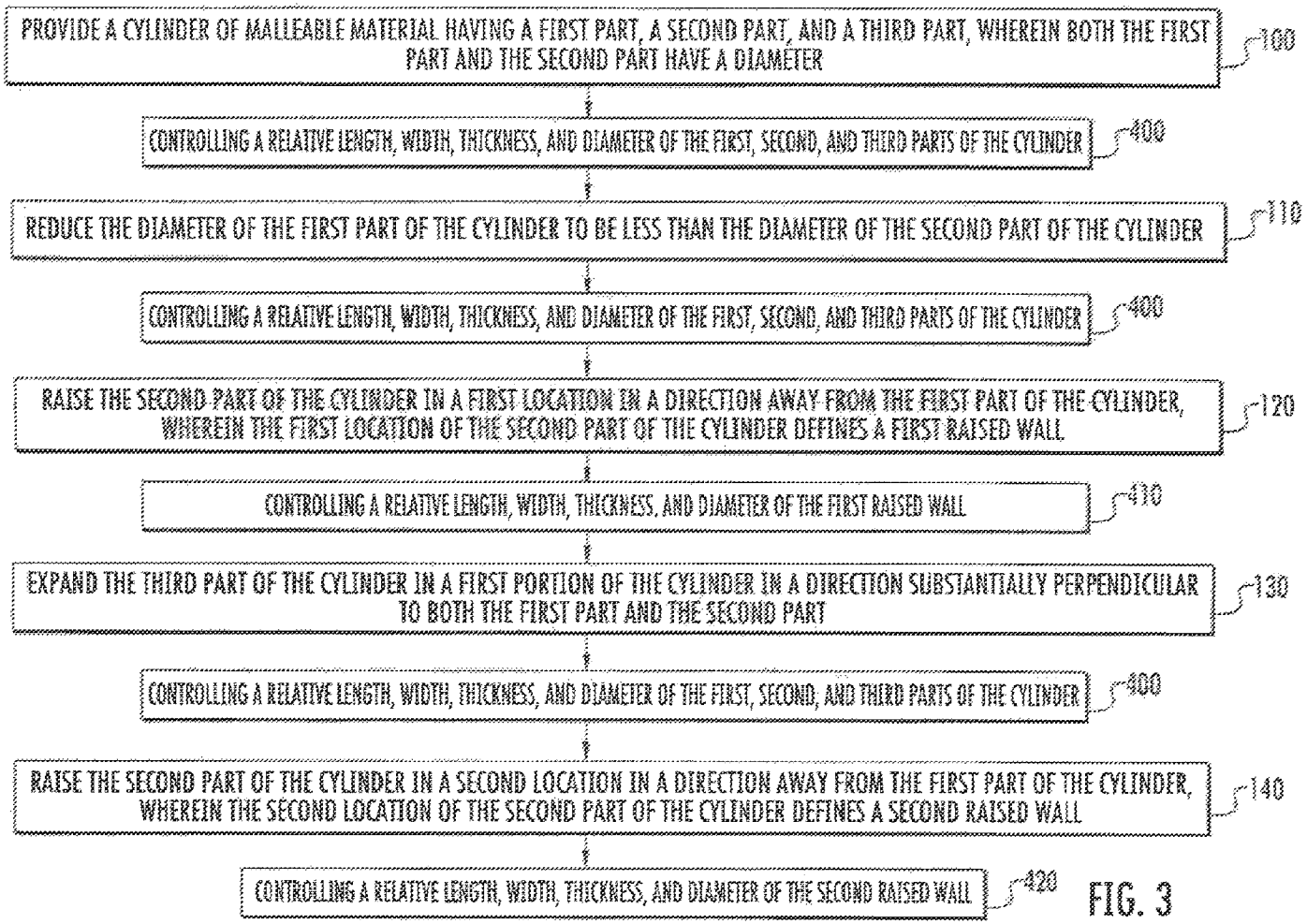
FIG. 3 depicts an embodiment of the method of providing an Integrated Valve Sleeve as shown in FIG. 1.

FIG. 3 depicts an embodiment where each forming step is controlled 400 such that the relative lengths, widths, thicknesses, and diameters conform to the dimensions of the desired integrated valve sleeve. The instant method contemplates that the specific dimensions of a solenoid assembly and a spool and sleeve valve are almost infinitely variable, and that the instant method is capable of providing an operable integrated valve sleeve compatible with any size solenoid and valve assembly as can be envisioned by those of ordinary skill in the art.

Figure 4:
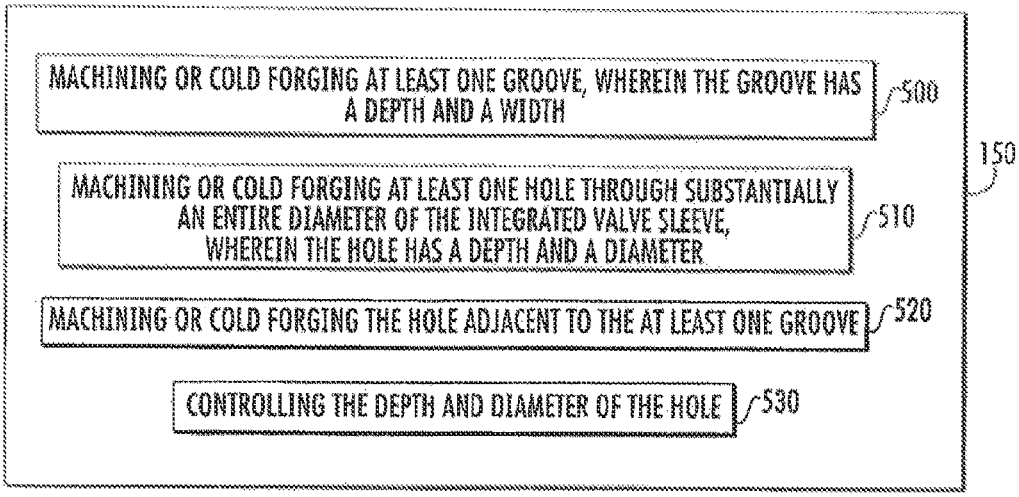
FIG. 4 depicts an embodiment of the method for creating grooves or holes in the Integrated Valve Sleeve as shown in FIG. 1.

FIG. 4 depicts the various embodiments in which one may provide 150 grooves or holes to the cylinder material. The grooves may be provided 500 by either cold-forging or machining, or a combination thereof. Those grooves that are provided either by cold-forging or machining are provided with a depth and a width. The specific dimensions of the grooves on the cylinder depend on the intended use of the integrated valve sleeve and are determinable by one of ordinary skill in the art.

Likewise, holes may be provided 510 to the surface of the cylinder of malleable material, also by either cold-forging or machining. In a manner akin to controlling the size of the grooves above, the holes will have a depth and a diameter which can be tailored by those of ordinary skill in the art for their purposes. In one embodiment, the holes extend along the entire diameter of the cylinder or longitudinally along the entire length of the cylinder. The holes and grooves can be provided in any number or configuration. In one embodiment, for example, they are provided 520 adjacent each other, alternatingly placed one after another after another. Further, all sizes and shapes of the holes or the grooves can be controlled 530 so as to be tailored for a specific use by one of ordinary skill in the art.

As shown in FIG. 1, in one embodiment the step of raising 120 the second part of the cylinder in a first location in a direction away from the first part of the cylinder such that the first location of the second part of the cylinder defines a first raised wall is performed by compressing 200 at least a second portion of the second part of the cylinder in an axial direction toward the first part of the cylinder. FIG. 1 further shows the step of raising 140 the second part of the cylinder in a second location in a direction away from the first part of the cylinder such that the second location of the second part of the cylinder defines a second raised wall may be performed by compressing 220 at least a third portion of the second part of the cylinder in an axial direction toward the first part of the cylinder such that the circumference of the first raised wall remains substantially unaltered. In all embodiments, it is contemplated that there may be variations in the method steps. By way of example, in an additional embodiment, the compression as described in step 200 may be reversed, so that the first part of the cylinder is compressed towards the second part of the cylinder to create the first raised wall. The same contemplated variation holds true for step 220, so that the first part of the cylinder is compressed towards the second part of the cylinder to create the second raised wall. Both of the above acceptable variations to the instant invention merely exemplary, and any similar variations that do not materially change the compression steps or the finished product are well within the abilities of one of ordinary skill in the art.

Figure 5:
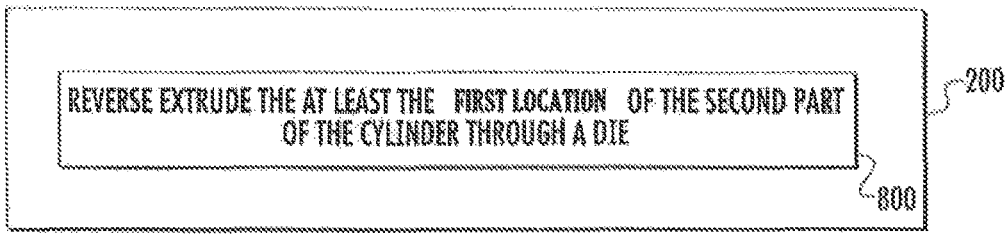
FIG. 5 depicts an embodiment of the method for compressing at least a second portion of the second part of the cylinder in a direction towards the first part of the cylinder as shown in FIG. 1.
Figure 6:
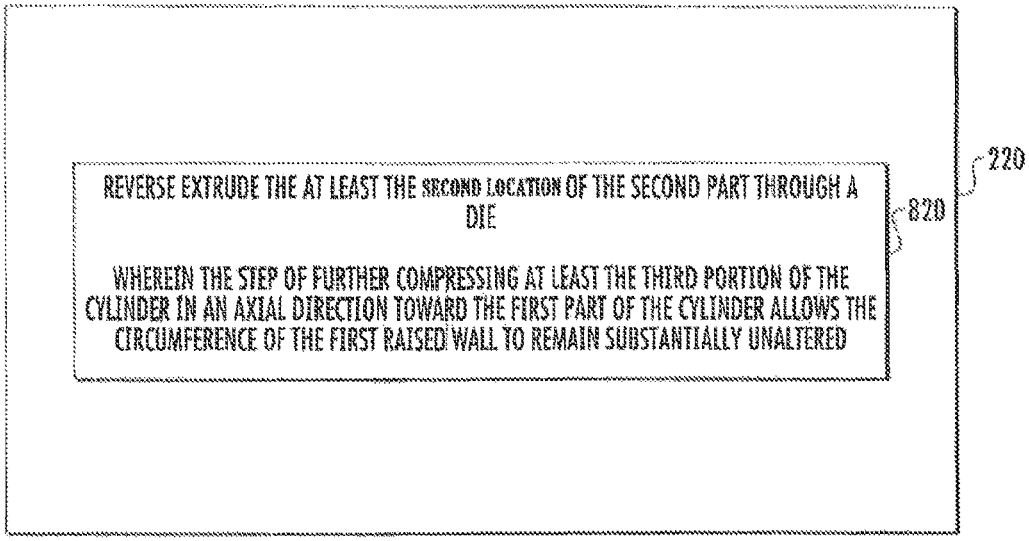
FIG. 6 depicts an embodiment of the method for compressing at least a third portion of the second part of the cylinder in an axial direction towards the first part of the cylinder as shown in FIG. 1.

FIGS. 5-6 contemplate that compression steps 200 and 220 may be performed by reverse extruding steps 800 and 820. In the case of step 800, the at least the first location of the second part is reverse extruded through a die, while in the case of step 820, at least the second location of the second part is reverse extruded through a die. While performing the reverse extrusion in step 820, the circumference of the first raised wall may remain substantially unaltered. These reverse extrusion steps may be performed by dies as shown in FIGS. 17-21, as will be discussed below.

Figure 7:
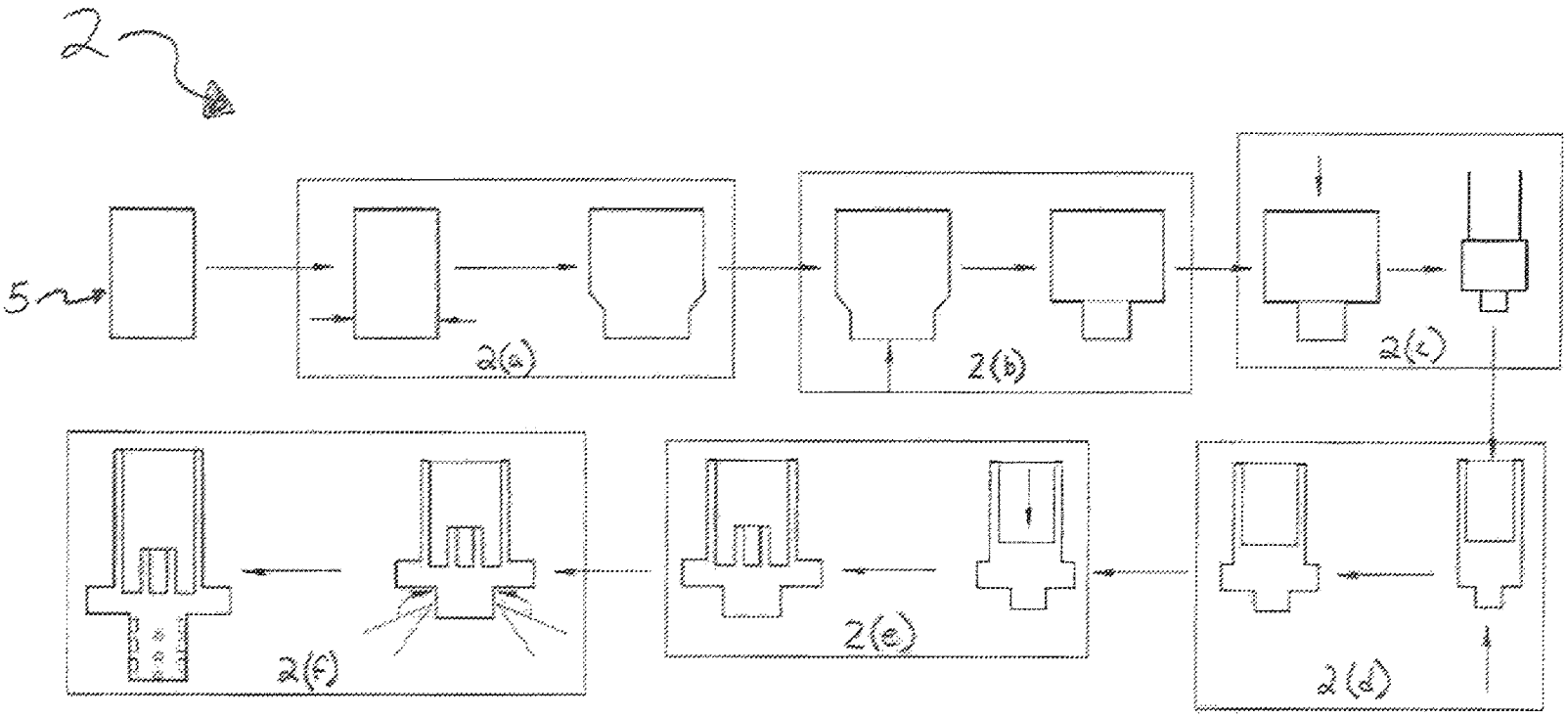
FIG. 7 depicts a graphical flowchart representing the forces exerted on the cylinder of malleable material in accordance with an embodiment of the method of making an Integrated Valve Sleeve as shown in FIG. 1.

FIG. 7 shows method 2, which is a graphical representation of one embodiment of method 1 as shown in FIG. 1. In this embodiment, cylinder of malleable material 5 is shown to be subjected to a series of compression forces to achieve a desired conformation. Each compression step and resulting conformational change is depicted in the corresponding sequentially labeled boxes, 2(*a*)-2(*f*). Each compression is represented by arrows, displaying the exemplary direction that the compression force may come from and the envisioned resulting conformational change to cylinder of malleable material 5. These compression steps are not the only compression steps envisioned by the method of the present invention and are meant to be exemplary only. The compression steps may be performed in any suitable order, with the compression coming from any suitable angle.

Figure 8:
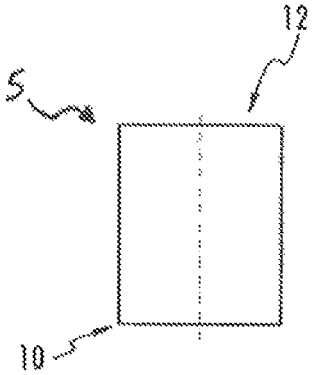
FIGS. 8-13 depict the cylinder of malleable material after each compression step in an embodiment of the method of making an Integrated Valve Sleeve as shown in FIG. 1.

FIG. 8 shows an embodiment of the starting cylinder of malleable material 5 to be provided by step 100 which will be fashioned into the integrated valve sleeve of the instant invention. In this embodiment, the cylinder 5 is shown to be taller than it is wide, though these dimensions or proportions should not be taken as limiting. It is well within the ability of one of ordinary skill in the art to select an appropriately sized and proportioned starting cylinder of malleable material 5. The cylinder 5 is shown to have a first part 10 and a second part 12, which are, in this embodiment, defining the bottom surface and the top surface of the cylinder 5, respectively.

Figure 9:
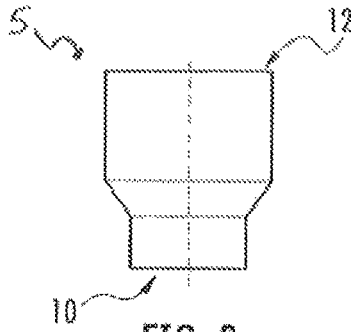
Figure 10:
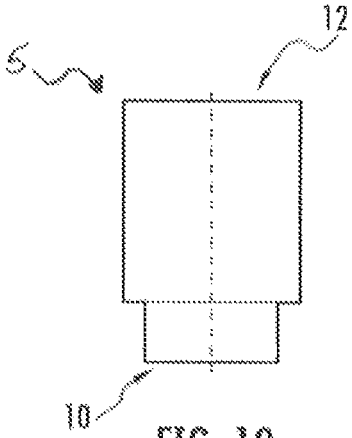

As shown in FIG. 1, after reducing 110 the diameter of the first part of the cylinder to be less than that of the second part of the cylinder, at least a portion of the cylinder 5 may be shaped 160. Those portions of the cylinder 5 which may be shaped include the first part of the cylinder, the second part of the cylinder, an area in between the first part and the second part of the cylinder, and any combination thereof. FIG. 9 shows a representation of the cylinder of malleable material 5 after step 110 from FIG. 1 which is ready for shaping as in step 160 for FIG. 1. The diameter of first part 10 has been reduced with respect to the second part 12, however there is now a tapered area (not numbered) disposed between the first and second parts of the cylinder. In this embodiment, the cylinder of malleable material 5 could be shaped in accordance with the invention by compressing the first part 10 of the cylinder 5 towards the second part 12 of the cylinder. In another embodiment, the second part 12 of the cylinder 5 may be compressed towards the first part 10 of the cylinder 5. Either compression step could produce the construct as shown in FIG. 10, where the compression step has eliminated the tapered section present in the FIG. 9. This compression step may create an elongated cylinder 5 and slightly increase the circumference of the second part 12, though that does not necessarily need to be the case. The actual shape and dimensions of the malleable material after step 160 are dependent on the dies used.

Figure 11:
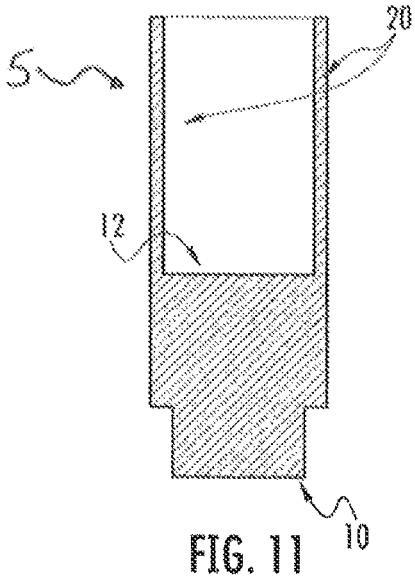

FIG. 11 is the physical representation of the raising step 120 from FIG. 1. Here, the second part 12 has been raised to provide a raised wall 20 around the circumference of second part 12. Such a method step 200 could be performed by compressing the second part 12 towards the first part 10, though it is contemplated that the first part 10 may be compressed towards the second part 12 as well. As described in FIG. 5, in one embodiment raising the first raised wall is performed by reverse extruding 800 the second part of the cylinder 5 through an annular die. Due to the annular shape of the die, the cylinder material of the second part 12 is forced upwards through the die, defining the raised wall 20 whose circumference is roughly the same as the circumference of the second part 12 prior to step 110. The height of raised wall 20 is dependent upon the extent to which the die compresses the second part 12 and the original size of the starting cylinder 5 material, both of which are design steps well within the abilities of one with ordinary skill in the art.

Figure 17:
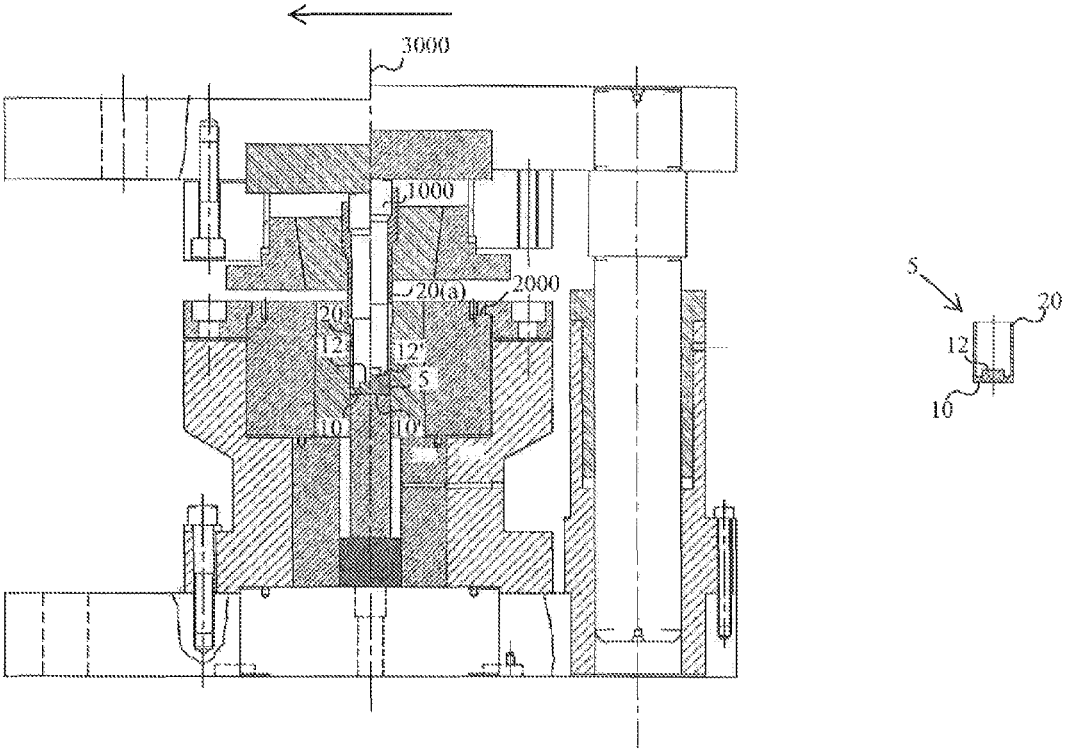
FIGS. 17-21 depict exemplary die conformations for performing the disclosed method as shown in FIG. 1.
Figure 18:
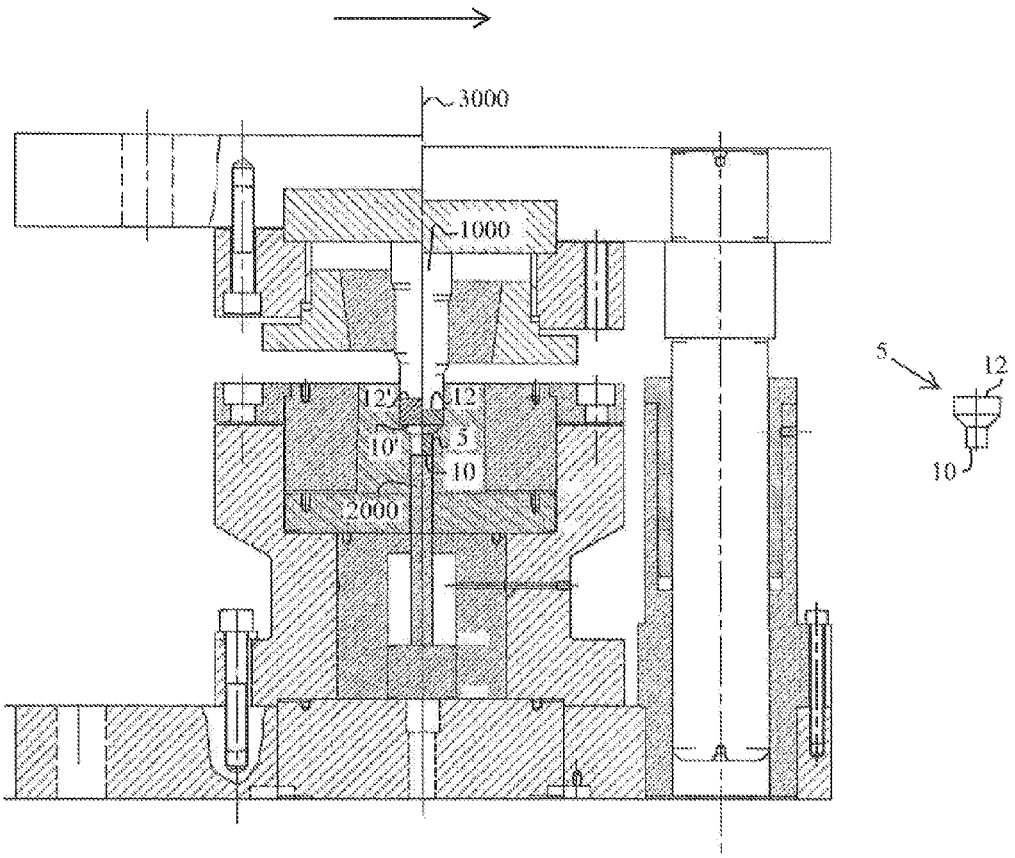
Figure 19:
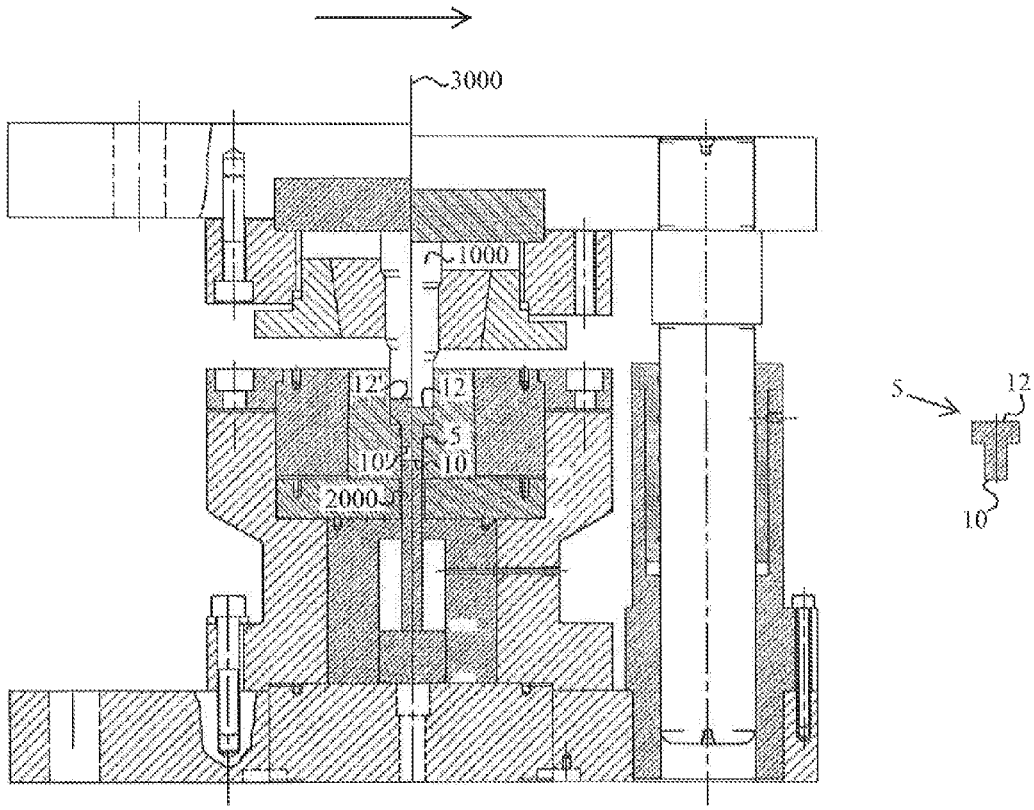
Figure 20:
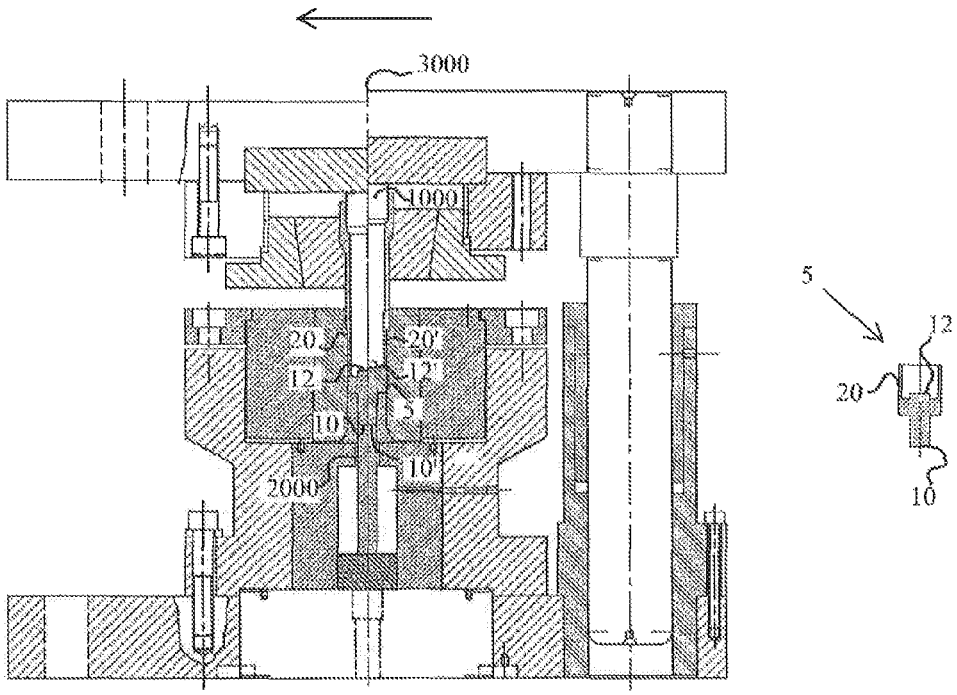
Figure 21:
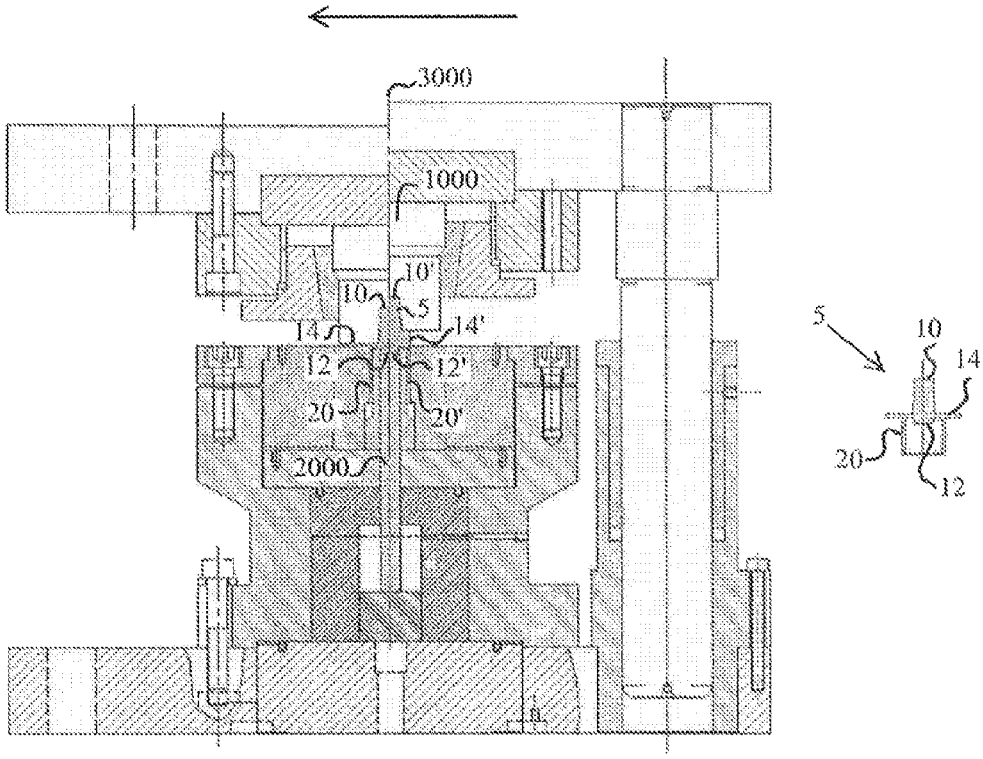

In one embodiment, the die for performing the raising step 120 is similar to the die apparatus as shown in FIG. 17. In this figure, the die 1000 for performing raising step 120 is displayed in a die body 2000. The cylinder of malleable material 5, defined here as having a first part 10' and second part 12', is placed in the die body 2000. Die 1000 is generally shaped to provide recesses into which the cylinder of malleable material 5 may be displaced after pressing the die into the cylinder 5 disposed in the die body. In this embodiment, there is space

20(*a*) left between the outer circumference of die 1000 and the inner circumference of die body 2000. As the first part 10' and second part 12' of the cylinder of malleable material 5 are pressed towards each other by the die 1000, the cylinder 5 is deformed into all recesses of the die 1000 and die body 2000, including the available space of 20(*a*). After compression and subsequent removal of die 1000, the cylinder of malleable material 5 retains the shape of the corresponding die 1000 and die body 2000, namely a first part 10, a second part 12, and a first raised wall 20, which was created as the cylinder of malleable material 5 was forced into available space 20(*a*).

In addition to FIG. 17, FIGS. 18-21 display die drawings for use in additional steps and embodiments of the proposed invention. Each figure displays the use of a specific die and the cold-forging principle described herein to achieve a desired integrated valve sleeve conformation. In each case, the die drawing displays a before and after conformation of the cylinder of malleable material 5 after a compression step from the die apparatus. Each drawing contains a line 3000, which acts as the defining boundary between the cylinder of malleable material 5 before each compression step and the cylinder of malleable material 5 after each compression step. The arrow above each figure points in the direction of the progression from cylinder of malleable material 5 before compression and cylinder of malleable material 5 after compression. As described with regards to FIG. 17 above, in each case die 1000 is inserted into die body 2000, which contains the cylinder of malleable material 5. In the cylinder's initial conformation, it is comprised of a first part 10' and a second part 12'. In one embodiment, there may be a space 20(*a*) disposed between die 1000 and die body 2000. By selective compression of first part 10' and second part 12' towards each other by the die 1000 and die body 2000, the cylinder of malleable material 5 is extruded, reverse extruded, or extruded and reverse extruded to yield the desired shape comprising at least a first part 10, a second part 12, and any additional desired structural features.

Figure 12:
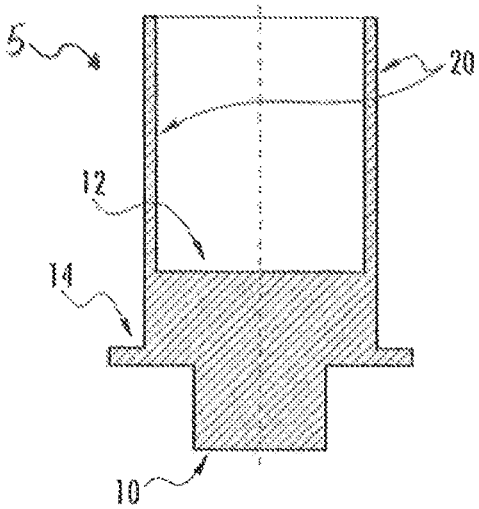

FIG. 12 is the physical representation of expanding step 130 from FIG. 1. As shown here, a third part of the cylinder 14, has been expanded between the first part 10 and the second part 12 to define a flattened disk which is which is disposed substantially parallel to the first 10 and second 12 parts. As shown in FIG. 1, this expansion 130 step can be accomplished in one embodiment by compressing the first part 10 towards the second part 12. Through the use of the appropriate die, as the first part 10 is compressed towards the second part 12, the material of the cylinder 5 is forced outwards to form a continuous ring 14 between the first part 10 and the second part 12. This is exemplified in FIG. 21, which portrays a die 1000 and die body 2000. In its initial conformation, the cylinder of malleable material 5 has a first part 10', a second part 12', a third part 14' which is disposed between the first part and the second part, and a first raised wall 20'. In this embodiment, as the die 1000 presses the cylinder of malleable material 5 into die body 2000, the cylinder of malleable material 5 is forced outwards to fill the available space as continuous ring 14.

Figure 13:
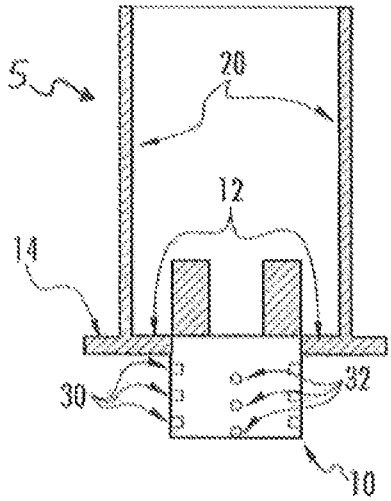

FIG. 13 is the physical representation of the final raising step 140 from FIG. 1. As with the previous raising step 120, the second part 12 is compressed towards the first part of the cylinder 10, which allows for the formation of a second raised wall 22. This embodiment is meant to be illustrative of the inventive concept only. For example, in this embodiment, the second raised wall 22 is shown to be a cylindrical cup, having a recess in the middle for accepting actuator assemblies and the like. However, in other embodiments, the second raised wall 22 could be a centrally located pole-like feature, having no recess in the middle and remaining substantially solid throughout. In one embodiment, the second raised wall 22 is reverse extruded through a die, such as shown in FIG. 17 described above. The specific size and shape of the die will determine the physical dimensions of the second raised wall 22, and the design and control of each of these variables is well within the ability of one of ordinary skill in the art. An additional embodiment could have the second raised wall 22 fashioned using a machining method as is well known in the art. In this embodiment, there would be no need to raise the second part of the cylinder to define the raised wall or compress the second part of the cylinder with an annular die to create the raised wall. Instead, the second part of the cylinder would be machined away in the desired areas to define the second raised wall 22. Once again, it is contemplated that the features of the integrated valve sleeve may be provided in any particular order. For example, in one embodiment, the expanding step 130 and the final raising step 140 can be reversed, such that the raising of the second raised wall in 140 occurs before the expanding step 130. Reversing these steps will not substantively change the integrated valve sleeve produced by the instant method.

The integrated valve sleeve of the current invention may undergo cold-forging or machining to add a series of holes and grooves in the base, as shown by the method steps 150 and 180 in FIG. 1. Exemplary embodiments exhibiting these holes and grooves is illustrated in FIGS. 13-16.

FIG. 13 shows a cut-away view of the holes 32 and the grooves 30. As is evident from the figure, the holes 32 and grooves 30 are disposed adjacent to and alternate with each other. As this is a cut-away figure, the holes 32 extend along at least substantially the entire diameter of the valve sleeve. The purpose of the holes is to provide passage for fluid flow through the valve sleeve in response to movements from a solenoid apparatus (not pictured) and valve components. The placement of the holes in FIGS. 13-16 is meant to be illustrative only. The specific placement of the holes and the number of holes on the valve sleeve is determined by the intended use of the valve sleeve and the specific valve and solenoid apparatus with which it is used, all of which are design features well within the abilities of one of ordinary skill in the art. With respect to the grooves 30, they extend around the entire circumference of the valve sleeve and operate as seals between various flow passages, which are defined by holes 32. In some embodiments, the grooves may be filled with elastomeric O-rings to provide this seal, or they may simply interlock with another housing (not pictured) with complementary ridges.

Figure 16:
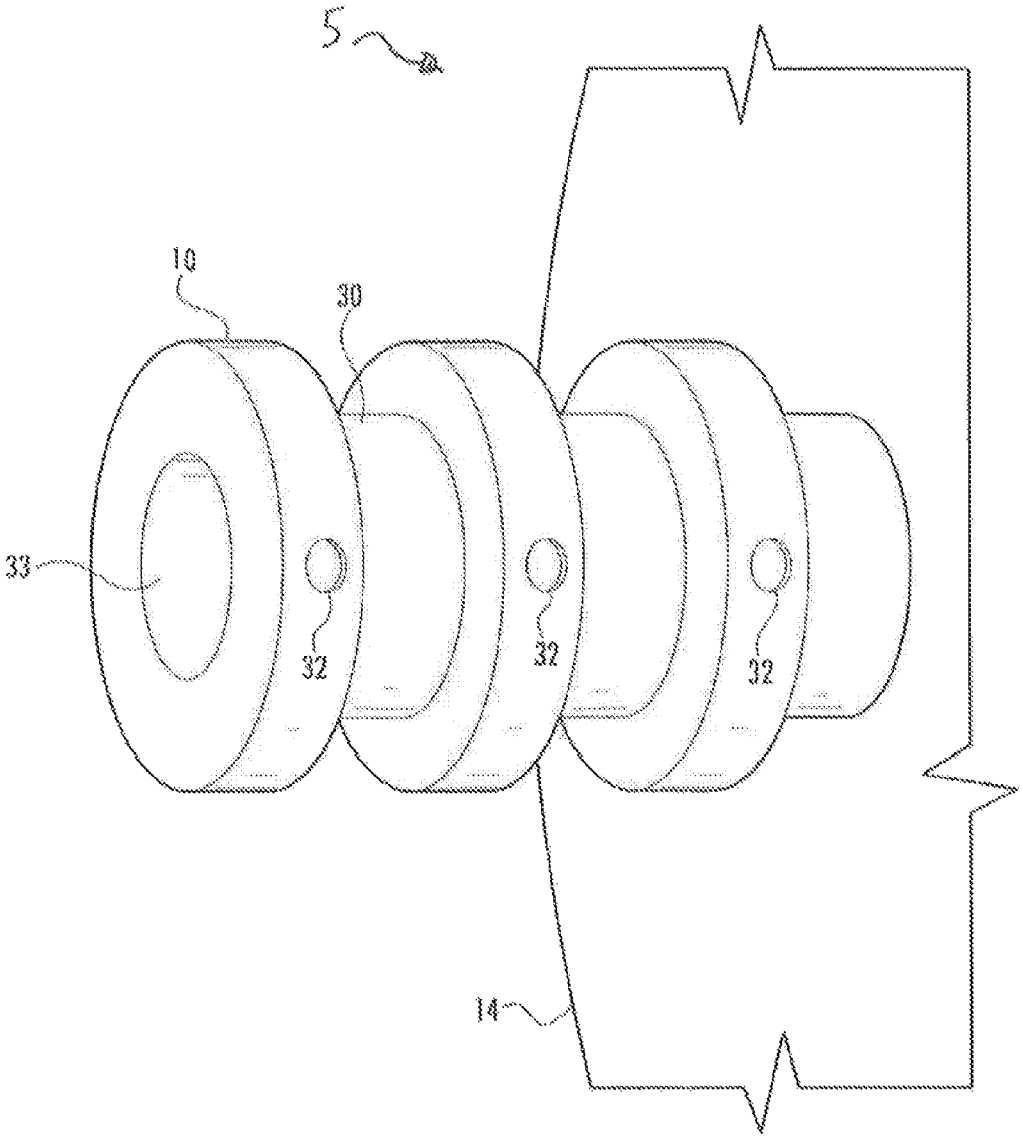
FIG. 16 depicts an enlarged version of the Integrated Valve Sleeve portion of FIG. 15.

FIG. 16 shows an additional embodiment where there is an additional hole 33 disposed in the first part 10. This hole 33 extends from the center of the first part up through the third part 14 and up through the middle of the second part 12. Essentially, then, the hole 33 provides a pathway extending through the center of the whole integrated valve sleeve. In one embodiment, the purpose of this hole 33 would be to accept a spool and solenoid actuator assembly.

As shown in FIG. 1, one embodiment of the method 1 comprises step 190 for controlling and orienting a plurality of grain lines in the valve sleeve. In one embodiment, a plurality of grain lines are oriented to be in a generally radial direction on the first, second, and third parts of the cylinder and in a generally axial direction elsewhere (such as on the raised walls, etc.). The advantage of orienting the plurality of grain lines in this manner is that it facilitates efficient flow of the electromagnetic field along the integrated valve sleeve. In a typical prior art housing and valve sleeve, the orientation of the grain lines are not controlled, resulting in grain lines which can be random, perpendicular, or at least angular with respect to each other and the flow of the electromagnetic field along the housing and valve sleeve. Such oriented grain lines unnecessarily inhibit the flow of the electromagnetic field.

An inherent advantage of the cold-forging method of the instant invention is that the grain lines will maintain their orientation through each compression step. For instance, if the grain lines of the cylinder of malleable material are parallel to each other prior to expanding 130 the third part of the cylinder from FIG. 1, the grain lines of the expanded third part will be parallel as well. Therefore, through this cold-forging method, the parallel grain lines prior to step 130 will become radially oriented parallel grain lines after step 130 is completed. This behavior follows for each method step shown in FIGS. 1-6. So long as the present cold-forging method is followed, the orientation of the grain lines in the formed integrated valve sleeve may remain uniformly oriented, facilitating the most unperturbed electromagnetic flow possible.

Figure 14:
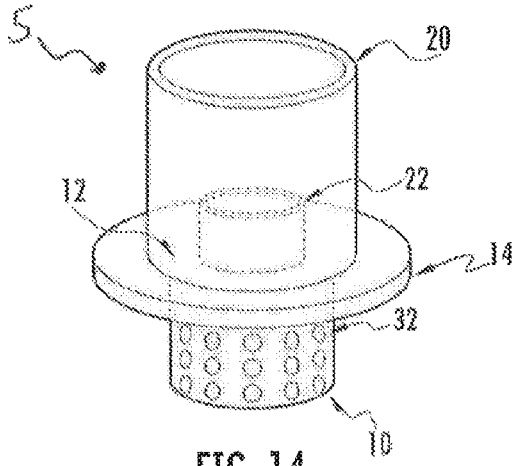
FIG. 14 depicts a three-dimensional representation of an Integrated Valve Sleeve as made by the method shown in FIG. 1.
Figure 15:
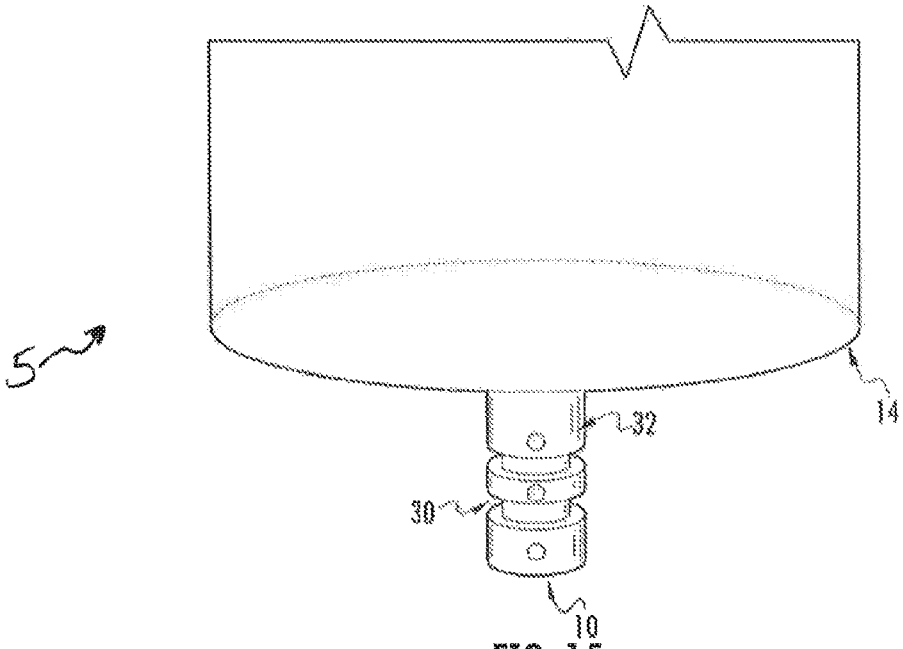
FIG. 15 depicts, in more detail, the valve sleeve portion of the Integrated Valve Sleeve of FIG. 14.

As shown in FIG. 1, the plurality of grooves 30 and holes 32 from FIGS. 14-16 may be provided through cold-forging or machining step 180. While the availability of certain equipment and personal preference may entice one of ordinary skill to choose one method over another, we acknowledge that either method could produce the desired grooves 30 or holes 32. Suitable machining methods include, but are by no means limited to: spin forming, shear forming, ultrasonic forming, chemical forming, and combinations thereof.

While the present invention has been particularly described, it is evident that many alternatives, modifications and variations will be apparent to those skilled in the art in light of the foregoing description. It is therefore contemplated that the appended claims will embrace any such alternatives, modifications, and variations as falling within the true scope and spirit of the present invention.

What is claimed is:

1. A method of providing an integrated valve sleeve comprising the steps of:

providing a cylinder of malleable material having a first part, a second part, and a third part, wherein both the first part and the second part have a diameter;

reducing the diameter of the first part of the cylinder to be less than the diameter of the second part of the cylinder;

raising the second part of the cylinder in a first location in a direction away from the first part of the cylinder, wherein the first location of the second part of the cylinder defines a first raised wall;

expanding the third part of the cylinder in a direction substantially perpendicular to both the first part and the second part, wherein expanding the third part of the cylinder further comprises expanding the third part of the cylinder in a first portion of the cylinder between the first part of the cylinder and the second part of the cylinder by compressing the first part of the cylinder in an axial direction toward the second part of the cylinder; and raising the second part of the cylinder in a second location in a direction away from the first part of the cylinder, wherein the second location of the second part of the cylinder defines a second raised wall;

wherein the cylinder has a mass and all of the first part, second part, third part, first raised wall, and second raised wall are formed from the cylinder material.

2. The method according to claim 1, wherein the step of raising the second part of the cylinder in a first location comprises the following step:

compressing at least a second portion of the second part of the cylinder in an axial direction toward the first part of the cylinder.

3. The method according to claim 1, wherein the step of raising the second part of the cylinder in a second location comprises the following step:

further compressing at least a third portion of the second part of the cylinder in an axial direction toward the first part of the cylinder;

wherein the step of further compressing at least the second portion of the cylinder in an axial direction toward the first part of the cylinder allows the circumference of the first raised wall to remain substantially unaltered.

4. The method according to claim 1 further comprising the step of maintaining the mass of the cylinder at a substantially constant value throughout a reduction of the diameter of the first part and creation of the first raised wall, second raised wall, and expansion of the third part.

5. The method according to claim 1, further comprising the step of creating at least one groove and at least one hole on a surface of the cylinder.

6. The method according to claim 1, further comprising the step of orientating a plurality of grain lines.

7. A method of providing an integrated valve sleeve comprising the steps of:

providing a cylinder of malleable material having a first part, a second part, and a third part, wherein both the first part and the second part have a diameter;

reducing the diameter of the first part of the cylinder to be less than the diameter of the second part of the cylinder;

raising the second part of the cylinder in a first location in a direction away from the first part of the cylinder, wherein the first location of the second part of the cylinder defines a first raised wall;

expanding the third part of the cylinder in a direction substantially perpendicular to both the first part and the second part;

raising the second part of the cylinder in a second location in a direction away from the first part of the cylinder, wherein the second location of the second part of the cylinder defines a second raised wall; and annealing the cylinder after at least one of the following steps:

providing the cylinder of malleable material having a first part, a second part, and a third part, wherein both the first part and the second part have a diameter;

reducing the diameter of the first part of the cylinder to be less than the diameter of the second part of the cylinder;

raising the second part of the cylinder in a first location in a direction away from the first part of the cylinder, wherein the first location of the second part of the cylinder defines a first raised wall;

expanding the third part of the cylinder in a direction substantially perpendicular to both the first part and the second part;

raising the second part of the cylinder in a second location in a direction away from the first part of the cylinder, wherein the second location of the second part of the cylinder defines a second raised wall;

wherein the cylinder has a mass and all of the first part, second part, third part, first raised wall, and second raised wall are formed from the cylinder material.

8. The method according to claim 7 further comprising the step of maintaining the mass of the cylinder at a substantially constant value throughout a reduction of the diameter of the first part and creation of the first raised wall, second raised wall, and expansion of the third part.

9. The method according to claim 7, further comprising the step of creating at least one groove and at least one hole on a surface of the cylinder.

10. The method according to claim 7, wherein the step of expanding the third part of the cylinder comprises the following step of:

expanding the third part of the cylinder in a first portion of the cylinder between the first part of the cylinder and the second part of the cylinder by compressing the first part of the cylinder in an axial direction toward the second part of the cylinder.

11. A method of providing an integrated valve sleeve comprising the steps of:

providing a cylinder of malleable material having a first part, a second part, and a third part, wherein both the first part and the second part have a diameter;

reducing the diameter of the first part of the cylinder to be less than the diameter of the second part of the cylinder;

raising the second part of the cylinder in a first location in a direction away from the first part of the cylinder, wherein the first location of the second part of the cylinder defines a first raised wall, wherein raising the second part of the cylinder in a first location further comprises compressing at least a second portion of the second part of the cylinder in an axial direction toward the first part of the cylinder, and wherein the step of compressing at least a second portion of the second part of the cylinder in an axial direction toward the first part of the cylinder includes reverse extruding the at least the first location of the second part of the cylinder through a die;

expanding the third part of the cylinder in a direction substantially perpendicular to both the first part and the second part; and raising the second part of the cylinder in a second location in a direction away from the first part of the cylinder, wherein the second location of the second part of the cylinder defines a second raised wall;

wherein the cylinder has a mass and all of the first part, second part, third part, first raised wall, and second raised wall are formed from the cylinder material.

12. The method according to claim 11, further comprising the step of:

annealing the cylinder after at least one of the following steps:

providing the cylinder of malleable material having a first part, a second part, and a third part, wherein both the first part and the second part have a diameter;

reducing the diameter of the first part of the cylinder to be less than the diameter of the second part of the cylinder;

raising the second part of the cylinder in a first location in a direction away from the first part of the cylinder, wherein the first location of the second part of the cylinder defines a first raised wall;

expanding the third part of the cylinder in a direction substantially perpendicular to both the first part and the second part;

raising the second part of the cylinder in a second location in a direction away from the first part of the cylinder, wherein the second location of the second part of the cylinder defines a second raised wall.

13. The method according to claim 11 further comprising the step of maintaining the mass of the cylinder at a substantially constant value throughout a reduction of the diameter of the first part and creation of the first raised wall, second raised wall, and expansion of the third part.

14. The method according to claim 11, further comprising the step of creating at least one groove and at least one hole on a surface of the cylinder.

15. A method of providing an integrated valve sleeve comprising the steps of:

providing a cylinder of malleable material having a first part, a second part, and a third part, wherein both the first art and the second art have a diameter;

reducing the diameter of the first part of the cylinder to be less than the diameter of the second part of the cylinder;

raising the second part of the cylinder in a first location in a direction away from the first part of the cylinder, wherein the first location of the second part of the cylinder defines a first raised wall;

expanding the third part of the cylinder in a direction substantiall perpendicular to both the first part and the second part;

raising the second part of the cylinder in a second location in a direction away from the first part of the cylinder, wherein the second location of the second part of the cylinder defines a second raised wall, wherein raising the second part of the cylinder in a second location further comprises further compressing at least a third portion of the second part of the cylinder in an axial direction toward the first part of the cylinder, wherein the step of further compressing at least the second portion of the cylinder in an axial direction toward the first part of the cylinder allows the circumference of the first raised wall to remain substantially unaltered, and wherein the step of further compressing at least a third portion of the second part of the cylinder in an axial direction toward the first part of the cylinder includes reverse extruding the at least the second location of the second part through a die;

wherein the cylinder has a mass and all of the first part, second part, third part, first raised wall, and second raised wall are formed from the cylinder material.

16. The method according to claim 15, wherein the step of raising the second part of the cylinder in a first location comprises the following step:

compressing at least a second portion of the second part of the cylinder in an axial direction toward the first part of the cylinder.

17. The method according to claim 16, wherein the step of compressing at least a second portion of the second part of the cylinder in an axial direction toward the first part of the cylinder includes reverse extruding the at least the first location of the second part of the cylinder through a die.

18. A method of providing an integrated valve sleeve comprising the steps of:

providing a cylinder of malleable material having a first part, a second part, and a third part, wherein both the first part and the second part have a diameter;

reducing the diameter of the first part of the cylinder to be less than the diameter of the second part of the cylinder;

raising the second part of the cylinder in a first location in a direction away from the first part of the cylinder, wherein the first location of the second part of the cylinder defines a first raised wall;

expanding the third part of the cylinder in a direction substantially perpendicular to both the first part and the second part;

raising the second part of the cylinder in a second location in a direction away from the first part of the cylinder, wherein the second location of the second part of the cylinder defines a second raised wall, wherein the step of creating the at least one groove and at least one hole on a surface of the cylinder is performed by a machining process selected from a group consisting of: spin forming, shear forming, ultrasonic forming, chemical forming, or combinations thereof; and creating at least one groove and at least one hole on a surface of the cylinder, wherein the step of creating the at least one groove and at least one hole on a surface of the cylinder is performed by a machining process selected from a group consisting of: spin forming, shear forming, ultrasonic forming, chemical forming, or combinations thereof;

wherein the cylinder has a mass and all of the first part, second part, third part, first raised wall, and second raised wall are formed from the cylinder material.

19. The method according to claim 18 further comprising the step of maintaining the mass of the cylinder at a substantially constant value throughout a reduction of the diameter of the first part and creation of the first raised wall, second raised wall, and expansion of the third part.

* * * * *